US005743719A

United States Patent [19]

Haga et al.

[11] Patent Number: 5,743,719

[45] Date of Patent: Apr. 28, 1998

[54] OIL-FREE SCROLL VACUUM PUMP HAVING A GAS BALLAST PART

[75] Inventors: Shuji Haga; Masaru Tsuchiya, both of Yokohama, Japan

[73] Assignee: Anest Iwata Corporation, Tokyo, Japan

[21] Appl. No.: 682,256

[22] Filed: Jul. 17, 1996

[30] Foreign Application Priority Data

Jul. 21, 1995 [JP] Japan ..... 7-207601

[51] Int. Cl.[6] ..... F04C 18/04; F04C 25/02

[52] U.S. Cl. ..... 418/15; 418/55.1; 418/55.2; 418/60

[58] Field of Search ..... 418/15, 55.1, 55.2, 418/60, 97

[56] References Cited

U.S. PATENT DOCUMENTS

| | | | |
|---|---|---|---|
| 2,885,143 | 5/1959 | Dubrovin | 418/15 |
| 3,677,664 | 7/1972 | Wycliffe et al. | 418/15 |
| 3,802,809 | 4/1974 | Vulliez | 418/55.2 |
| 4,407,641 | 10/1983 | Long | 418/15 |
| 5,258,046 | 11/1993 | Haga et al. | 418/55.2 |

FOREIGN PATENT DOCUMENTS

| | | | |
|---|---|---|---|
| 63-1782 | 1/1988 | Japan | 418/55.2 |
| 2161190 | 6/1990 | Japan | 418/55.1 |
| 3111690 | 5/1991 | Japan | 418/15 |

*Primary Examiner*—John J. Vrablik

*Attorney, Agent, or Firm*—Evenson, McKeown, Edwards & Lenahan P.L.L.C.

[57] ABSTRACT

It is sought to provide an oil-free scroll vacuum pump, which can discharge condensed fluid in it to the outside. An oil-free scroll vacuum pump body 1 for withdrawing fluid from a vessel to be evacuated, compressing the fluid and discharging the compressed fluid to the outside, comprises a stationary scroll constituted by a housing half 4 and a wrap 7, another stationary scroll constituted by a housing half 5 and a wrap 6, and a revolving scroll 3. The housing half 4 has a gas ballast gas inlet duct 10 and an inlet port **4*a*, and the revolving scroll 3 has a communication hole 3*e*. Gas is introduced through the inlet port 4*e* into a sealed space defined by wraps of the individual scrolls engaged with one another. The introduced gas is compressed together with compression fluid in the sealed space, and the resultant fluid is discharged through a discharge port 4*c*** to the outside.

2 Claims, 7 Drawing Sheets

OIL-FREE SCROLL VACUUM PUMP HAVING A GAS BALLAST PART

BACKGROUND OF THE INVENTION

1. Field of the Invention

This invention relates to an oil-free scroll vacuum pump for compressing fluid with stationary and revolving scrolls and, more particularly, to oil-free scroll vacuum pump, in which gas is introduced into a sealed space defined by wraps of the scrolls engaged with one another through a gas ballast gas inlet port formed in the stationary scroll, and compressed fluid in the sealed space is discharged together with the introduced gas to the outside.

2. Description of the Prior Art

FIG. 7 shows a well-known scroll vacuum pump. This scroll vacuum pump comprises a main shaft 56, a revolving scroll 51 supported on a central crank portion 55*a* of the main shaft 56 and having revolving wraps formed on each axial side, a pair of stationary scrolls 52A and 52B each having a stationary wrap engaged with each revolving wrap, and three eccentric rotatable shafts 53 disposed at a circumferential interval of 120° for rotation restriction.

The stationary scrolls 52A and 52B are disc-like and form together a casing with their peripheral walls sealed together via an intervening seal member to define an inner sealed space. They have respective central holes 51*a*, through which the main shaft 56 is mounted via bearings. The main shaft 56 is thus supported rotatably by two-point support.

The stationary scrolls 52A and 52B have respective spiral stationary wraps 50, which are disposed symmetrically around such that they face each other. The stationary scroll 52A has a discharge port 57 and a withdrawal port 58, formed in its central portion and its outer periphery, respectively.

The revolving scroll 51 has revolving wraps 54 each formed on each axial side and capable of being engaged with each stationary wrap 50. The eccentric rotatable shafts 53 are rotatably supported in peripheral portions of the revolving scroll 51.

The eccentric rotatable shafts 53 each have opposite side portions rotatably supported in the stationary scrolls 52A and 52B for rotation restriction of the revolving scroll 51 by two-point support. Designated at 59A and 59B are tip seals fitted in the tips of the wraps.

With this structure, by driving the main shaft 56 for rotation, eccentric rotatable motion of the eccentric shaft portion 55*a* is brought about to cause revolution of the revolving scroll 51 with a predetermined radius about the wrap center of the stationary scrolls 52A and 52B while preventing the rotation of the revolving scroll 51.

Consequently, gas withdrawn through the withdrawal port 58 is introduced into the sealed space defined by the wraps of the stationary and revolving wraps to be progressively compressed and displaced toward the wrap center, and compressed gas is discharged through the discharge port 57.

Where the above prior art technique is employed, gas in a sealed vessel, which is connected to the withdrawal port 58, is withdrawn by the scroll vacuum pump. Therefore, water content in the gas is readily gasified with pressure reduction in the vessel.

This means that the gas withdrawn into the scroll vacuum pump may contain water vapor. In this case, when the saturation vapor pressure is exceeded as a result of the compression of the gas containing water vapor, condensation and liquefaction of water vapor result, and only compressed gas is discharged through the discharge port. The remaining water content is accumulated in a lower part of the discharge port in the final space defined by the revolving and stationary scrolls.

Whenever compressed gas is introduced from the preceding sealed space, it strikes the accumulated water content to cause generation of abnormal sound and deterioration of inner components used for the pump, as well as deteriorating the performance and durability of the pump.

OBJECT AND SUMMARY OF THE INVENTION

In view of the foregoing, it is an object of the invention to provide an oil-free scroll vacuum pump, in which liquid generated in it as a result of condensation is discharged to the outside of it.

A feature of the invention resides in an oil-free scroll vacuum pump for compressing fluid with revolving and stationary scrolls to discharge the compressed fluid to the outside, wherein:

gas is introduced into a sealed space defined by wraps of the scrolls engaged with one another through a gas ballast gas inlet port formed in the stationary scroll; and the introduced gas is compressed together with compression fluid in the sealed space, the resultant fluid being discharged to the outside.

With this structure, when the pressure in the vessel to be evacuated is to the external atmospheric pressure, the pressure in the sealed space into which gas is introduced through the inlet port, is already be higher than the atmospheric pressure. When the pressure under which the gas is to be introduced is lower than the pressure in the vessel, no gas is introduced through the inlet port.

When the gas in the vessel already contains water vapor at this time, the pressure in the final sealed space exceeds the saturation vapor pressure. Thus, water vapor is condensed and liquified, resulting in accumulation of water content on inner surfaces of the wraps defining the final sealed space.

As the pressure in the vessel to be evacuated is reduced, gasification of water content in the vessel proceeds. However, even with compression of the fluid taken out of the vessel and entering the sealed space, the pressure in the sealed space into which the gas is introduced through the inlet port, becomes lower than the gas to be introduced through the inlet port. The gas thus is introduced through the inlet port.

At this time, the ratio of the water vapor contained in the introduced gas is reduced. Also, the final sealed space is compressed to reduce the partial water vapor pressure when it is communicated with the discharge port to be below the saturation water vapor pressure of the scroll pump. The water vapor is thus discharged, without being liquified, through the discharge port while gasifying the water attached to the wrap surfaces as a result of the condensation and liquefaction.

Suitably, three or more sealed spaces are formed in a preceding stage to the gas introduction sealed space for compressing fluid therein.

With this structure, sufficient compression ratio can be obtained.

Another feature of the invention resides in the oil-free scroll vacuum pump, wherein:

the gas ballast gas inlet port has an opening formed in a revolving scroll wrap sliding surface, the opening having a diameter smaller than the wrap width and being capable of being opened and closed with the driving of the revolving scroll wrap; and the opening of the gas ballast gas inlet port is closed in synchronism to an instant when the final sealed space formed between the stationary and revolving scrolls is communicated with a discharge passage leading to the outside.

With this structure, when the final sealed space is in communication with the discharge passage, the inlet port is held closed to prevent reverse flow of compressed fluid to the inlet port, thus allowing the compressed fluid to be discharged through the discharge passage to the outside.

The reverse flow of the compressed fluid can be prevented with a simple structure of setting the inlet port opening diameter to be smaller than the wrap width, and no particular check valve need be provided at the inlet port.

A further feature of the invention resides in the oil-free scroll vacuum pump, which comprises:

a revolving scroll having wraps formed on each of the front and back sides, the revolving scroll being capable of being driven for revolving relative to a first and a second stationary scroll each having a wrap engaged with each of the revolving scroll wraps;

the gas ballast gas inlet port being provided in either of the first and second stationary scrolls, the sealed space formed by the other stationary scroll and the revolving scroll being communicated with a gas supply passage for supplying the gas; and the one stationary scroll having a discharge port, through which resultant fluid resulting from the compression of compression fluid in the sealed space together with the introduced gas is discharged to the outside.

With this structure, the inlet port and the compressed fluid discharge port are provided in only one of the two stationary scrolls. Thus, these ports can be disposed concentrated on a portion of that stationary scroll on the side thereof opposite the wrap. Simpler structure and readier manufacture are thus possible compared to the case of providing these ports distributed in the two stationary scrolls.

In addition, the gas introduced through the inlet port into the sealed space defined by one of the wrap of the revolving scroll and the wrap of one of the stationary scrolls, is introduced through a communication hole provided in the revolving scroll into the other sealed space defined by the other wrap of the revolving scroll and the wrap of the other stationary scroll.

The gas ballast gas inlet port thus need not be provided in both the stationary scrolls, but it may be provided in only one of the stationary scrolls. Simple structure and ready manufacture are thus obtainable.

DETAILED DESCRIPTION OF THE PREFERRED EMBODIMENT

Figure 1:
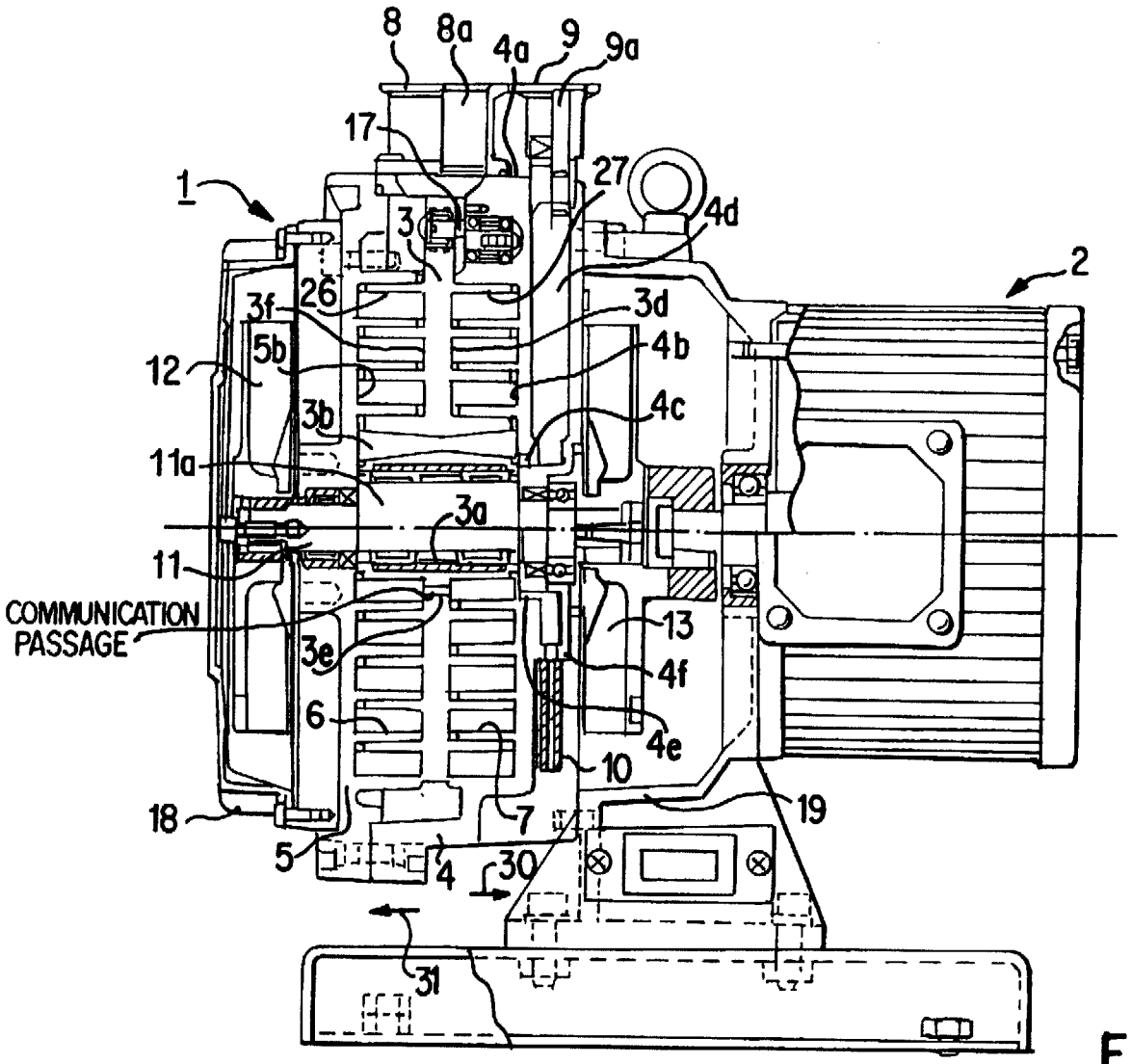
FIG. 1 is a side view, partly in section, showing a twin type oil-free scroll vacuum pump as an embodiment of the invention.
Figure 2:
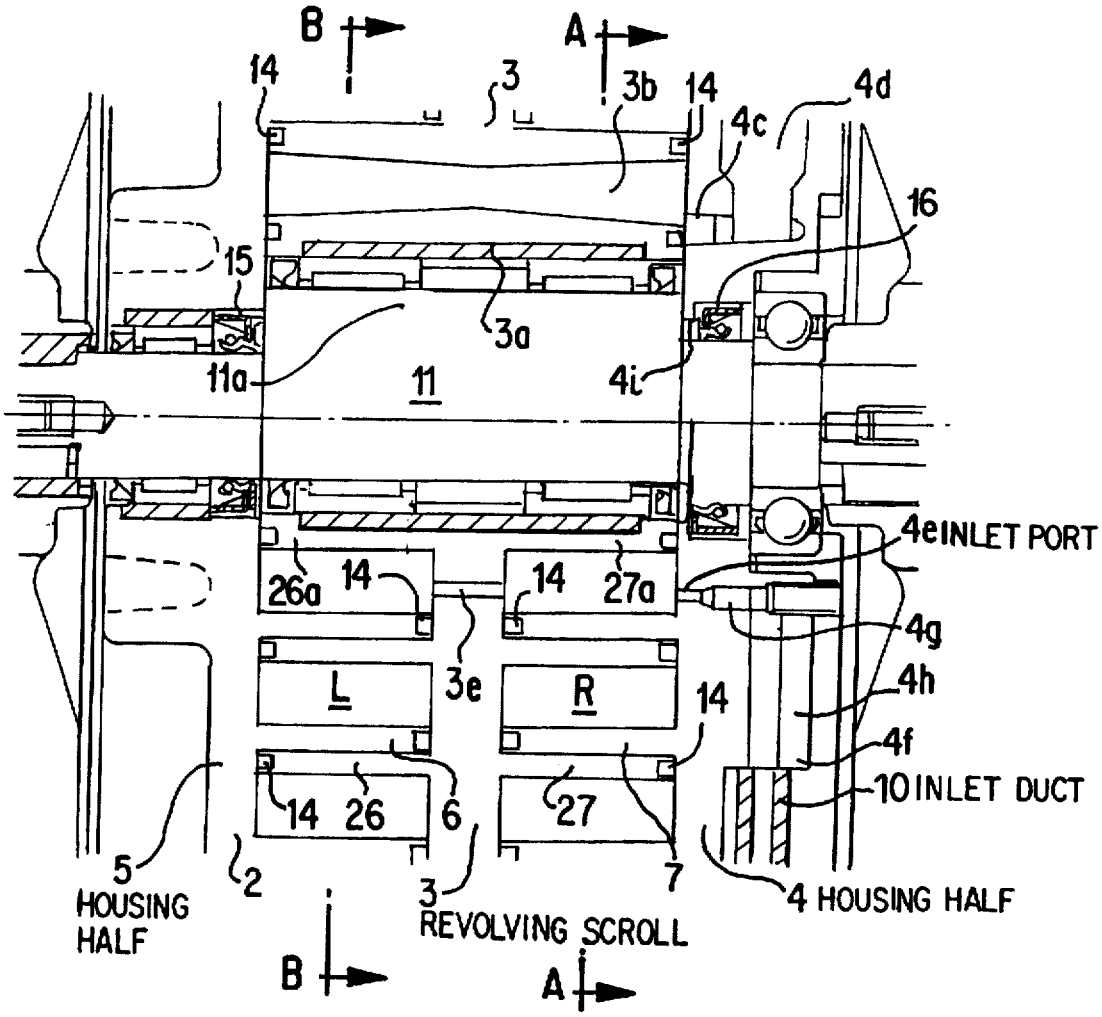
FIG. 2 is a fragmentary enlarged-scale view showing a portion shown in FIG. 1.

FIGS. 1 and 2 show a twin type oil-free scroll vacuum pump embodying the invention. Referring to FIG. 1, the pump comprises a pump body 1 having a shaft 11, which is coupled at the right end to the drive shaft of a motor 2 and driven by the torque thereof.

The shaft has an axially central eccentric portion 11*a* having a slightly greater diameter. The eccentric portion 11*a* is rotatable with its opposite end portions supported in bearings of housing halves 4 and 5 and packings.

The housing halves 4 and 5 are disc-like and constitute respective stationary scrolls. Their peripheral walls are sealed to each other via an intervening seal member, thus defining a sealed space in them.

The housing half 4 has a wrap sliding surface 4*b* perpendicular to its axial direction. In the wrap sliding surface 4*b*, a central hole 4*i* (FIG. 2) is formed, in which a non-eccentric portion of the shaft 11 other than the eccentric portion 11*a* is rotatably fitted. In the wrap sliding surface 4*b*, a spiral wrap 7 is embedded with its end 7*a* (FIG. 3) in the vicinity of the hole 4*i*, for clockwise rotation when viewed in the direction of arrow 30. The wrap 7 has a tip groove formed along its tip. In the tip groove a tip seal 14 (FIG. 2) is fitted, which is made of a fluorine resin or the like and has self-lubricating property so that it provides perfect seal with its associated wrap sliding surface in contact therewith.

The wrap sliding surface 4*b* has a discharge port 4*c* (FIGS. 2 and 3) with an opening thereof located in the vicinity of the end 7*a* of the wrap 7. Compressed gas is discharged through a discharge port 4*c* and a discharge passage 4*d* and from discharge opening 9 formed in the outer peripheral surface 4*a* of the housing half 4 to the outside.

The housing half 4 has a stem portion 4*f* on the side opposite the wrap having a gas ballast gas inlet duct 10. Gas is introduced through the inlet duct 10 and a passage 4*g* and from an inlet port 4*e* into a sealed space R.

Three revolving mechanisms 17 are provided in peripheral portions of the housing half 4 at circumferential intervals of 120°.

The revolving mechanisms 17 are coupled to a revolving scroll to be described later.

The housing half 4 has a withdrawal opening 8 formed in its outer periphery. The withdrawal opening 8 is coupled to a vessel (not shown) to be evacuated. Gas in the vessel thus can be withdrawn through an opening 8*a*.

The housing half 5 has a wrap sliding surface 5*b* perpendicular to its axial direction. In the wrap sliding surface 5*b*, a central hole is formed, in which a non-eccentric portion of the shaft 11 other than the eccentric portion 11*a* is rotatably fitted. In the wrap sliding surface 5*b*, a spiral wrap 6 is embedded with its end in the vicinity of and around the hole for counterclockwise rotation when viewed in the direction of arrow 31. The wrap 6 has a tip groove formed along its tip. A tip seal 14 (FIG. 2) is fitted in the tip groove, which provides for perfect seal with the associated wrap sliding surface in contact therewith.

A revolving scroll 3 is disposed for revolving in the inner space defined by the housing halves 4 and 5.

The revolving scroll 3 is disc-like and has wraps 26 and 27 embedded in its opposite side wrap sliding surfaces 3*d* and 3*e* and capable of engaging with the associated stationary scroll wraps.

The wrap 27 which engages with the wrap 7 is rotatable clockwise when viewed in the direction of arrow 30, and the wrap 26 which engages with the wrap 6 is rotatable counterclockwise when viewed in the direction of arrow 31.

The revolving scroll 3 has a central hole 3*a*, in which the eccentric portion 11*a* of the shaft 11 is rotatably fitted. The hole 3a is surrounded by the wraps 26a and 27a (FIG. 2) over the entire length of the eccentric portion 11a of the shaft 11.

As shown in FIG. 2, a sealed space R into which gas ballast gas is introduced, is defined by the wrap 7 of the stationary scroll and the wrap 27 of the revolving scroll 3. Another sealed space L is defined by the wrap 6 of the stationary scroll and the wrap 26 of the revolving scroll 3. The sealed spaces R and L are communicated with each other by a communication passage 3e. Thus, gas introduced through the inlet duct 10 is led through the sealed space R and communication passage 3e to fill the sealed space L.

As shown in FIG. 1, fans 12 and 13 for cooling the vacuum pump 11 are provided on portions of the shaft 11 extending outward from the housing halves 5 and 4, and are protected by covers 18 and 19 each having a plurality of air vent holes and mounted on the housing halves 5 and 4.

As described before, three revolving mechanisms 17 are provided at a circumferential spacing of 120° such that they are supported at one end in an outer peripheral portion of the revolving scroll and at the other end in the housing 4. The revolving scroll is revolved via the revolving mechanisms 17 about an axis of revolution which is eccentric with the stationary scrolls.

Figure 3A:
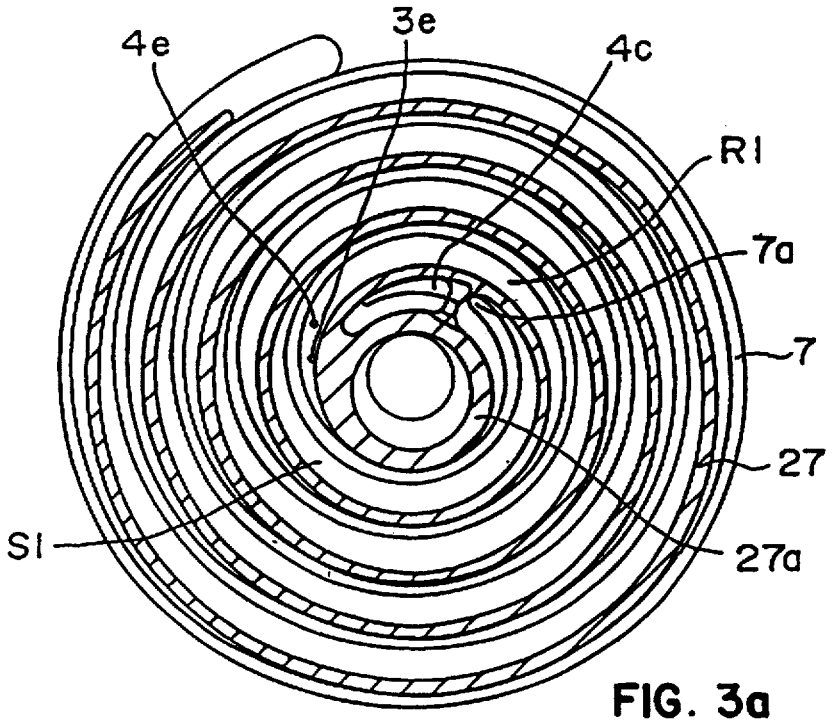
FIGS. 3(*a*) and 3(*b*) are schematic views showing scroll states when introduction of gas ballast gas is started.
Figure 3B:
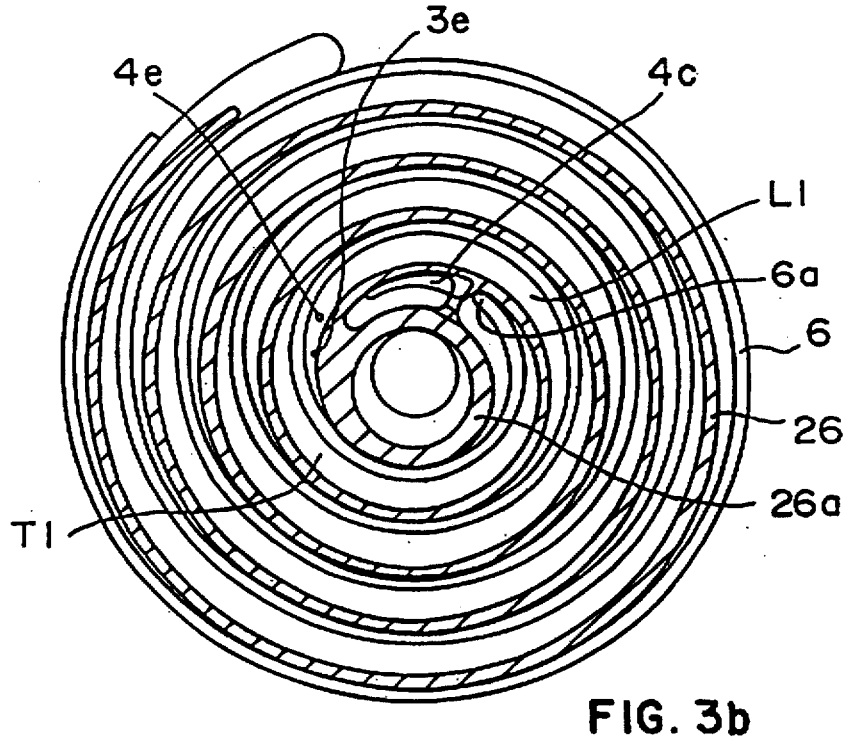

The operation of the embodiment having the above construction will now be described with reference to FIGS. 3(*a*) and 3(*b*) to 6(*a*) and 6(*b*). FIGS. 3(*a*) to 6(*a*) are views taken along line A—A in FIG. 2, and FIGS. 3(*b*) to 6(*b*) are views taken along line B—B in FIG. 2.

Referring to FIG. 1, when the shaft 11 is rotated, the revolving scroll 3 undergoes revolution to withdraw gas from a vessel (not shown). The gas is introduced from the outer periphery of the stationary scroll wraps 6 and 7 by the revolving scroll wraps 26 and 27 into sealed spaces defined by the wraps of the stationary and revolving scrolls to be compressed in these sealed spaces. When gas that has been compressed in three or more sealed spaces is led through sealed space R0 as shown in FIG. 6(*a*) to sealed space R1 as shown in FIG. 3(*a*), the inlet port 4e from the inlet duct 10 is closed.

In this state, the pressure in the sealed space R1 into which gas is introduced through the inlet port 4e, is already higher than the external atmospheric pressure when the pressure in the vessel to be evacuated is close to the atmospheric pressure. When gas to be introduced through the gas ballast gas inlet duct 10 is under a higher pressure than the pressure in the vessel, it is not introduced through the inlet port 4e.

Figure 4A:
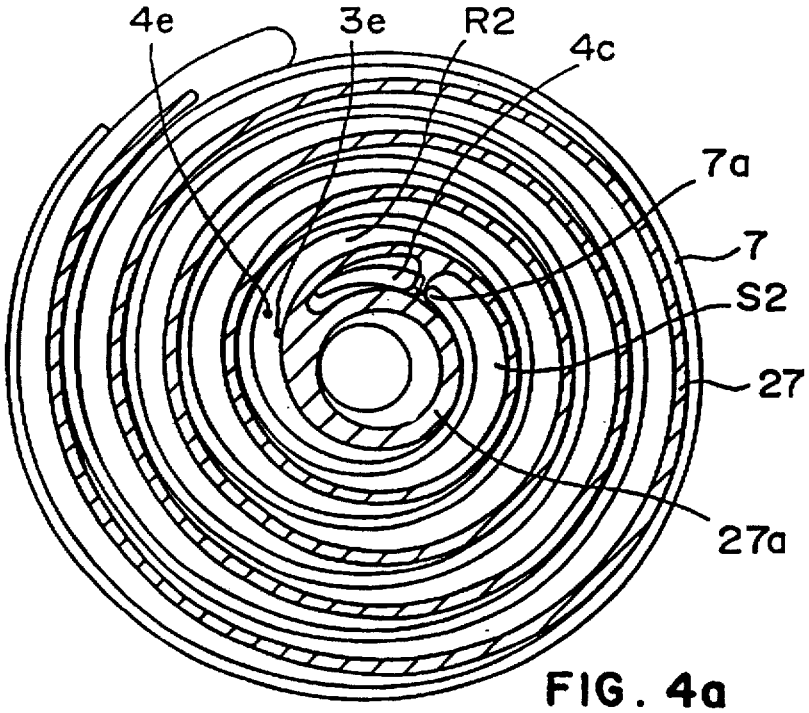
FIGS. 4(*a*) and 4(*b*) are schematic views showing scroll states when gas ballast gas is being introduced.
Figure 4B:
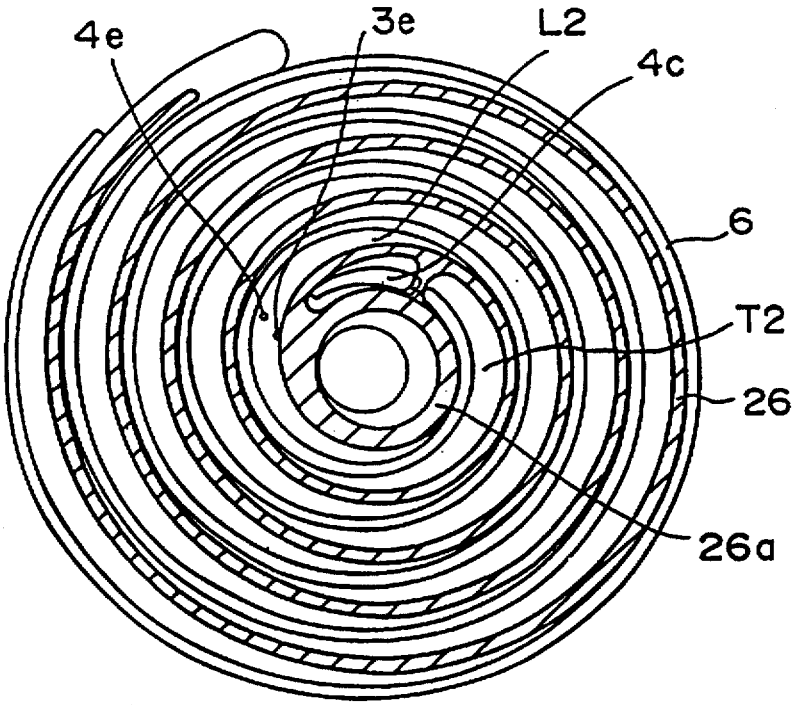
Figure 5A:
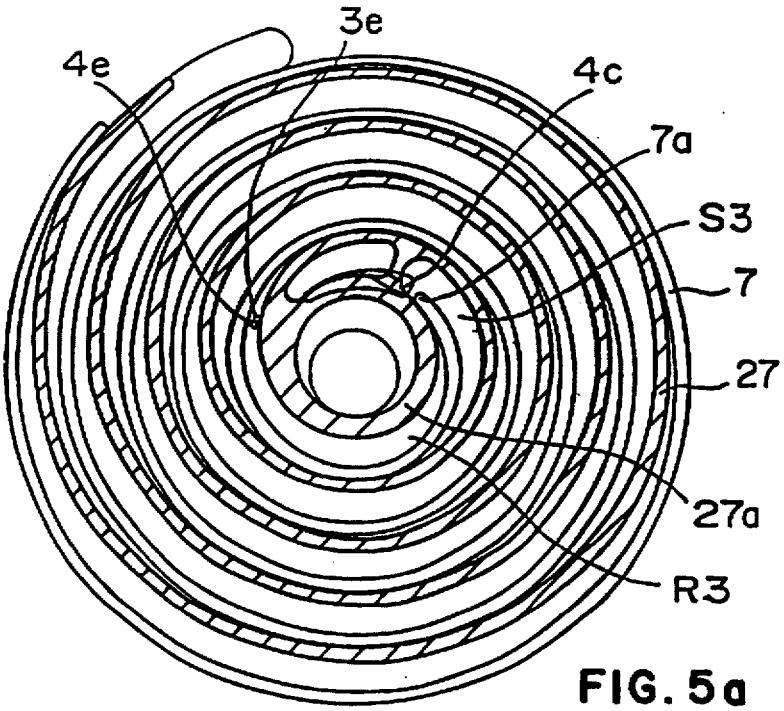
FIGS. 5(*a*) and 5(*b*) are schematic views showing scroll states right before the end of the gas ballast gas introduction.
Figure 5B:
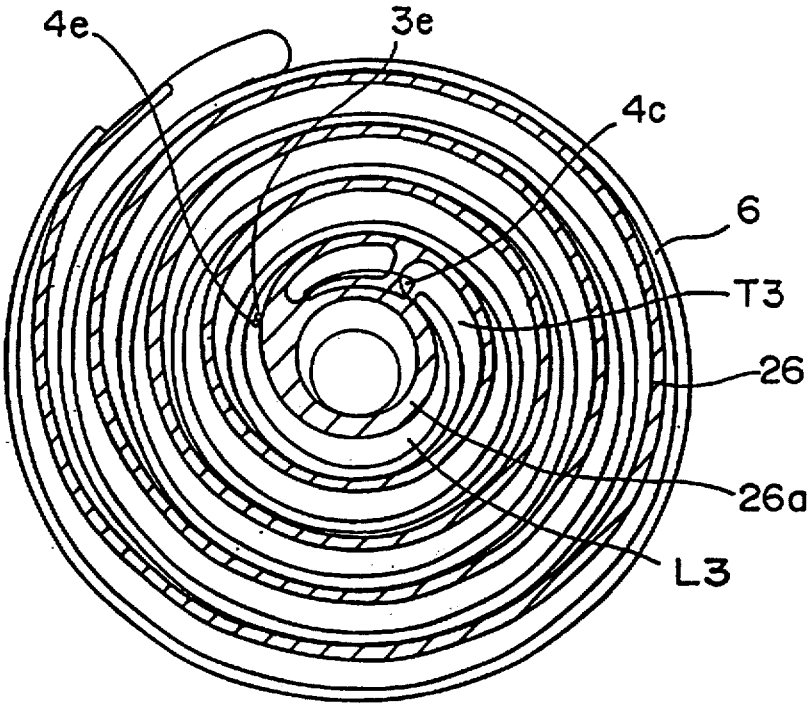
Figure 6A:
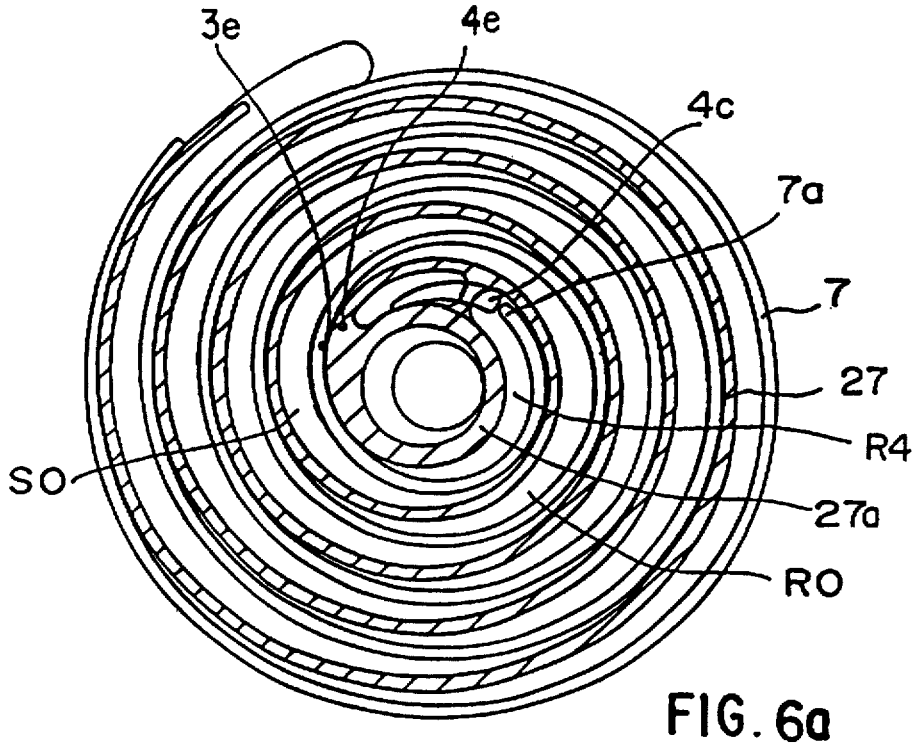
FIGS. 6(*a*) and 6(*b*) are schematic views showing scroll states when a gas ballast gas inlet port is closed.
Figure 6B:
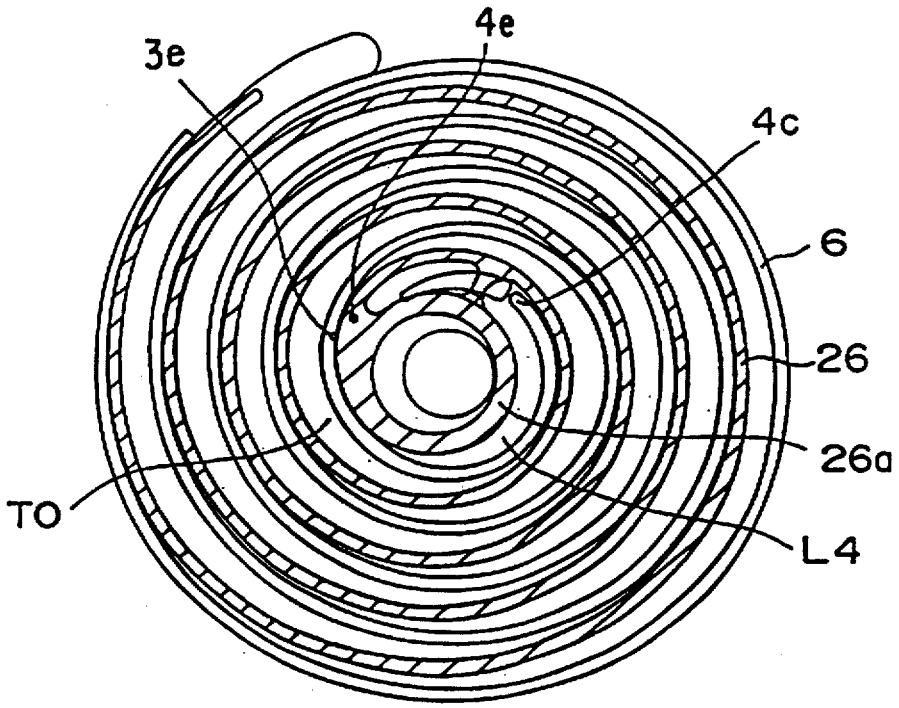
Figure 7:
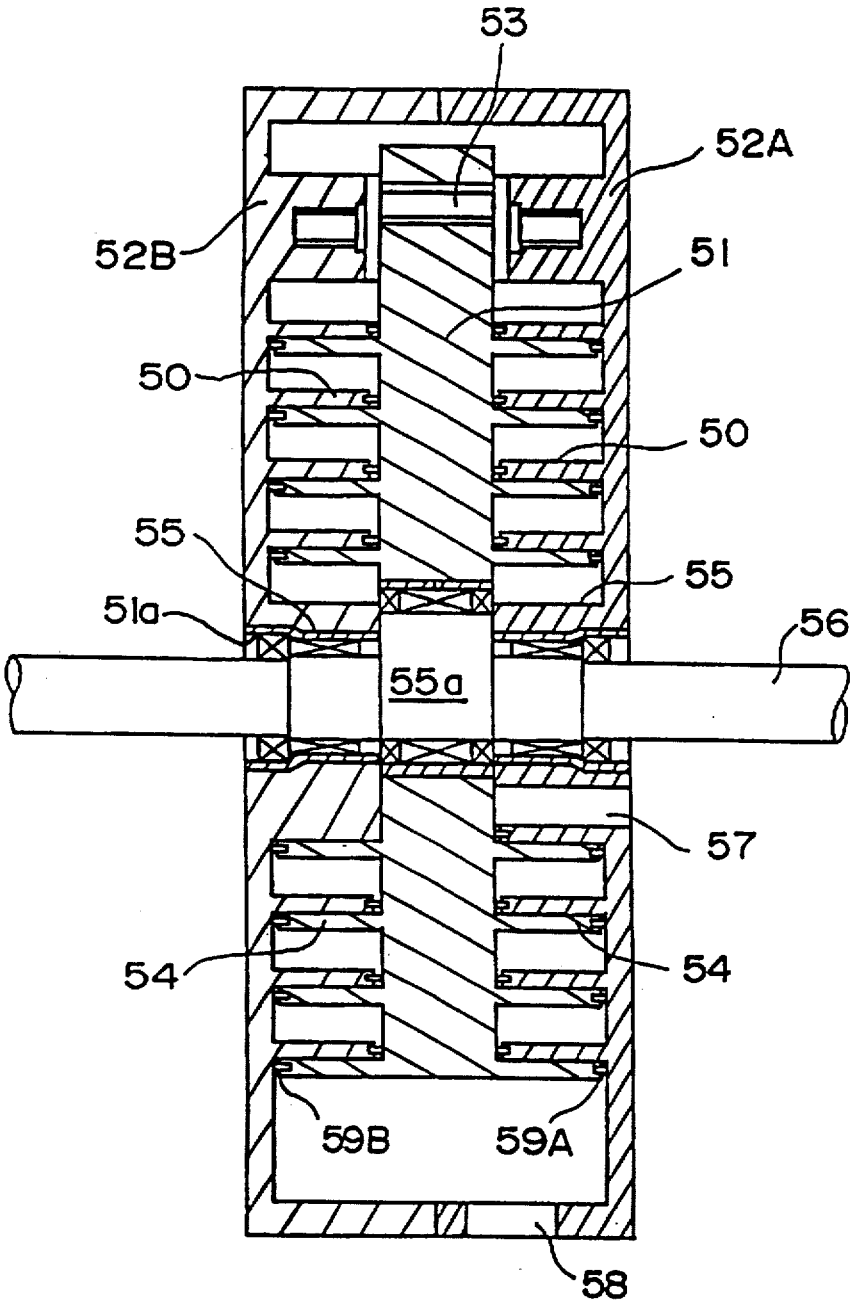
FIG. 7 is a sectional view showing a prior art structure.

With the revolution of the revolving scroll, the sealed spaces R and L are changed in volume to R1 and L1 (FIGS. 3(*a*) and 3(*b*)), R2 and L2 (FIGS. 4(*a*) and 4(*b*), then to R3 and L3 (FIGS. 5(*a*) and 5(*b*)), and then to R4 and L4 (FIGS. 6(*a*) and 6 (*b*), and the compressed gas is discharged through the discharge port 4c.

When the gas in the vessel contains water vapor at the instant corresponding to the sealed space volumes R1 and L1, the saturation water vapor pressure is exceeded in the final sealed spaces R4 and L4, thus resulting in condensation and liquefaction of water vapor so that water is attached to and accumulated on the wrap surfaces defining the final sealed spaces.

When water vapor has been liquified until reaching of the sealed space volumes R1 and L1, slight water flows reversely through the inlet port 4e of the stationary scroll to the inlet duct 10. However, water that intrudes into the inlet duct 10 is very slight because the inlet port 4e is narrow and also gas ballast gas is present therein.

As the pressure in the vessel to be evacuated is reduced, gasification of water content in the vessel proceeds. However, even with compression of the withdrawn fluid until reaching of the sealed spaces, the pressure in the sealed spaces R1 and L1 into which gas is introduced through the gas ballast gas inlet port 4e becomes lower than the pressure of the gas to be introduced from the inlet port 4e. Gas is thus introduced through the inlet port 4e.

At this time, the ratio of the water vapor contained in the introduced gas is reduced. Also, the fluid containing the water vapor is compressed down to the volumes R2 and L2 (FIGS. 4(*a*) and 4(*b*)), and then to the volumes R3 and L3 (FIGS. 5(*a*) and 5(*b*)).

At this time, the pressure of the compression fluid in the sealed spaces becomes higher than the pressure of the gas ballast gas. However, compression fluid that flows reversely through the inlet port 4e is slight because the inlet port 4e is small in diameter, the revolving scroll is driven at a high speed and gas ballast gas is present in the inlet duct. In addition, right before the sealed spaces of volumes R4 and L4 (FIGS. 6(*a*) and 6(*b*)) are communicated with each other through the communication hole 4c, the inlet port 4e of the stationary scroll is closed by the wraps 26a and 27a of the revolving scrolls.

In the above way, the partial water vapor pressure when the sealed spaces are compressed and communicated with the discharge port (FIGS. 6(*a*) and 6(*b*)), is reduced to be lower than the saturation vapor pressure in the pump. The compressed fluid is thus discharged through the discharge port 4c without liquefaction of the water vapor while gasifying water attached to the wrap surfaces as a result of condensation and liquefaction of water vapor.

With rotation of the shaft 11 by 90°, the sealed spaces S0(*a*) and T0(*b*) as shown in FIGS., 6(*a*) and 6(*b*) are compressed to volumes S1(*a*) and T1(*b*) as shown in FIGS. 3(*a*) and 3(*b*). The gas ballast gas inlet port is not present in these compressed sealed spaces. After their volumes S2 and T2 as shown in FIGS. 4(*a*) and 4(*b*), the sealed spaces are communicated with their volumes S3 and T3 as shown in FIGS. 5(*a*) and 5(*b*) with the discharge port 4c, whereby the compressed fluid is discharged to the outside. In this process, the saturation vapor pressure is exceeded, so that it is possible that water is generated as a result of condensation and liquefaction of water vapor and attached to and accumulated on the wrap surfaces defining the final sealed spaces.

Even in this case, after the discharge of compressed fluid in the sealed spaces S3 and T3 through the discharge port 4c, the sealed spaces R4 and L4 (FIGS. 6(*a*) and 6(*b*)) in communication with the gas ballast gas inlet duct is communicated with the discharge port 4c. Thus, compressed fluid having a lower partial water vapor pressure than the saturation water vapor pressure is discharged through the discharge port 4c while water generated as a result of the condensation and liquefaction of water vapor in the sealed spaces S3 and T3 is gasified.

As has been shown, in this embodiment, the opening of the gas ballast gas inlet port 4e, having a smaller diameter than the wrap width, is provided in the wrap sliding surface of the stationary scroll such that it can be opened and closed with the driving of the revolving scroll wrap and is closed in synchronism to the instant when the final sealed space defined by the stationary and revolving scrolls is communicated with the discharge passage leading to the outside. That is, when the final sealed space is in communication with the discharge passage, it is not in communication with the gas ballast gas inlet port 4*e*. Reverse flow of the compression fluid back to the inlet port 4*e* is thus prevented, while the compressed fluid is discharged through the discharge passage to the outside.

The reverse flow of the compression fluid is prevented with a simple arrangement of merely setting the diameter of the inlet port opening to be smaller than the wrap width and without need of providing any particular check valve at the inlet port 4*e*.

In addition, the revolving scroll has the wraps formed on its front and back surfaces, respectively, and is supported for revolution by the first and second stationary scrolls each having the wrap thereof engaged with each of its wraps, one of the first and second stationary scrolls has the gas ballast gas inlet port 4*e*, the revolving scroll has the communication hole 3*e* for supplying gas to the sealed space defined between it and the other stationary scroll, and the first-mentioned one stationary scroll has the discharge port 4*c*, so that the compression fluid in the sealed space is compressed together with the introduced ballast gas to discharge the resultant gas to the outside. The inlet port 4*e* and discharge port 4*c* are thus disposed concentrated on the portion of one stationary scroll on the side thereof opposite the wrap. Simpler structure and readier manufacture are thus obtainable compared to the case where the individual ports are disposed distributed in the two stationary scrolls.

Moreover, the gas introduced through the gas ballast gas inlet port 4*e* into the sealed space defined by one wrap of the revolving scroll and the wrap of one stationary scroll, is introduced through the communication hole 3*e* formed in the revolving scroll into the other sealed space defined by the other wrap of the revolving scroll and the wrap of the other stationary scroll. The gas ballast gas inlet port thus need not be provided in both the stationary scrolls, but it may be provided in only one of the stationary scrolls. Simpler structure and readier manufacture thereof are thus obtainable.

The above embodiment can be modified variously.

For example, while in the above embodiment gas from the gas ballast gas inlet port is introduced into the sealed spaces R and L, this is by no means limitative; it is possible to introduce the gas ballast gas into the sealed spaces S and T.

The gas ballast gas inlet duct 10 and discharge passages 4*c* and 4*d*, may be provided on the side of the housing half 5 instead of the side of the housing half 4.

It is possible to provide both the housing halves 4 and 5 with inlet ducts to introduce gas ballast gas into the sealed spaces R and L formed by the revolving and stationary scroll wraps from both sides. In this case, the communication hole 3*e* communicating the sealed spaces R and L with each other is unnecessary. In addition, since gas ballast gas is introduced quickly from both sides, the pumping efficiency can be increased.

It is possible to provide discharge passages in the housing half 5 along with those 4*c* and 4*d* in the housing half 4.

As the gas ballast gas, the external atmospheric air may be introduced through the inlet duct 10. Desirably, air, $N_2$ gas or like dry gas may be introduced by heating it. Doing so accelerates the drying of water vapor or liquid in the sealed space defined by the scroll wraps, thus promoting the prevention of deterioration.

Where the above embodiment is used to withdraw harmful gas or the like from the vessel, it is possible to dilute the harmful gas to a safe level by introducing $N_2$ or like diluting gas from the inlet duct.

As has been described in the foregoing, with the oil-free scroll vacuum pump according to the invention gas is introduced through the gas ballast gas inlet port provided in the stationary scroll into the sealed space defined by the stationary and revolving scroll wraps engaged with one another for compression together with compression fluid in the sealed space. Liquid generated in the pump as a result of condensation, thus can be discharged to the outside.

What is claimed is:

1. An oil-free scroll vacuum pump comprising revolving and stationary scrolls with wraps which engage one another to define between them at least one sealed space which is compressed as the revolving scroll revolves, said pump having a peripheral withdrawal opening through which a fluid is drawn into said sealed space, a central discharge opening through which fluid from the sealed space is discharged from the pump when the sealed space is brought into communication therewith, and a gas ballast inlet port communicating with a source of ballast gas and formed through a stationary scroll sliding surface such that the port can open into said sealed space; the port having a diameter smaller than the wrap width of the revolving scroll such that the port is opened and closed when the revolving scroll wrap slides across the stationary scroll sliding surface as the revolving scroll revolves; and said port being positioned such that it is closed by the revolving scroll wrap when the sealed space is brought into communication with the discharge opening; whereby ballast gas introduced through the port is compressed together with fluid from the withdrawal opening in the sealed space and the resultant fluid is discharged from the pump through the discharge opening.

2. An oil-free scroll vacuum pump comprising revolving and stationary scrolls with wraps which engage one another to define between them at least one sealed space which is compressed as the revolving scroll revolves, said revolving scroll having first and second wraps on opposed axial end faces each engaging a stationary wrap of a respective stationary scroll formed on adjacent first and second housing members to form respective sealed spaces on opposite sides of the revolving scroll, one of said first and second housing members having a peripheral withdrawal opening through which a fluid is drawn into the sealed space between the stationary scroll of said one housing member and the revolving scroll and a central discharge opening with which the sealed space between the stationary scroll of said one housing member and the revolving scroll may be brought into communication as the revolving scroll revolves to discharge fluid from the pump, said pump further comprising a gas ballast inlet port communicating with a source of ballast gas and formed through one of the stationary scrolls such that the port can open into the sealed space formed between that stationary scroll and the revolving scroll, the port having a diameter smaller than the wrap width of the revolving scroll such that the port is opened and closed when the revolving scroll wrap slides across the stationary scroll as the revolving scroll revolves; and the port being positioned such that it is closed by the revolving scroll wrap when the sealed space is brought into communication with the discharge opening; and a gas supply passage formed through said revolving scroll such that the sealed spaces on both sides of the revolving scroll are in communication with each other, whereby fluid from said withdrawal opening and ballast gas from said inlet port can pass into the sealed spaces on both sides of the revolving scroll and compressed fluid from said sealed spaces on both sides of the revolving scroll can pass to the discharge opening.

* * * * *

UNITED STATES PATENT AND TRADEMARK OFFICE

CERTIFICATE OF CORRECTION

PATENT NO. : 5,743,719

DATED : April 28, 1998

INVENTOR(S) : Shuji Haga; Masaru Tsuchiya

It is certified that error appears in the above-indentified patent and that said Letters Patent is hereby corrected as shown below:

On the title page, item [54] and Col. 1, line 2, delete "PART" and insert --PORT --.

Signed and Sealed this

Twenty-third Day of June, 1998

Bruce Lehman

*Attest:*

BRUCE LEHMAN

*Attesting Officer*

*Commissioner of Patents and Trademarks*